United States Patent [19]

Redman

[11] 4,320,161

[45] Mar. 16, 1982

[54] WEATHER STRIPPING MATERIAL

[75] Inventor: Ronald E. Redman, Niles, Mich.

[73] Assignee: Kawneer Company, Inc., Niles, Mich.

[21] Appl. No.: 75,272

[22] Filed: Sep. 13, 1979

[51] Int. Cl.[3] ..... E06B 7/16

[52] U.S. Cl. ..... 428/122; 49/490; 52/716

[58] Field of Search ..... 49/488, 489, 490, 494; 52/399, 403, 716; 428/83, 122, 358

[56] References Cited

U.S. PATENT DOCUMENTS

| | | | |
|---|---|---|---|
| 2,203,522 | 6/1940 | Clark | 49/489 X |
| 2,718,677 | 9/1955 | Cornell | 49/489 X |
| 3,341,975 | 9/1967 | Tylisz | 49/488 X |
| 3,638,359 | 2/1972 | Kruschwitz | 428/122 X |
| 3,656,260 | 4/1972 | Weaver et al. | 49/489 |
| 4,030,245 | 6/1977 | Yeomans | 49/490 |
| 4,092,813 | 6/1978 | Eggert | 52/403 X |
| 4,105,814 | 8/1978 | Eggert | 52/716 X |

FOREIGN PATENT DOCUMENTS

| | | |
|---|---|---|
| 821193 | 9/1959 | United Kingdom . |
| 892364 | 3/1962 | United Kingdom . |
| 1416151 | 12/1975 | United Kingdom . |
| 1447571 | 8/1976 | United Kingdom . |
| 1535030 | 12/1978 | United Kingdom . |

*Primary Examiner*—Henry F. Epstein

*Attorney, Agent, or Firm*—Mason, Kolehmainen, Rathburn & Wyss

[57] ABSTRACT

The present invention relates to weather stripping materials and more particularly to a readily deformable weather stripping material for use with a building component, such as a door, having a movable structural member provided with an elongated weather strip receiving channel along a movable edge thereof. In essence, the material comprises an elongated flexible plastic strip of substantially U-shaped cross section which is adapted to be inserted into the weather strip receiving channel and is provided with a base and two spaced apart legs joining the base throughout their lengths. Each of the spaced apart legs comprises an outer end segment which is formed of a plastic material having greater flexibility than that of the companion base joining segment of the same leg, the two segments of each leg being joined together throughout their lengths. The legs are also provided with inwardly disposed elongated ridges along the lengths thereof which face toward each other and are adapted to function as fastener head retaining barriers.

13 Claims, 5 Drawing Figures

Fig. 1
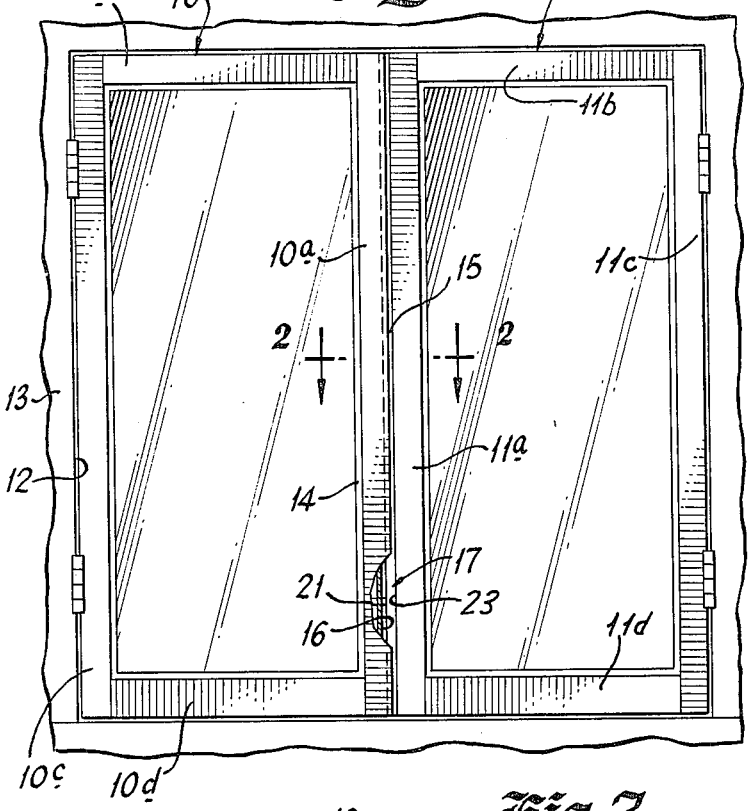
Fig. 3
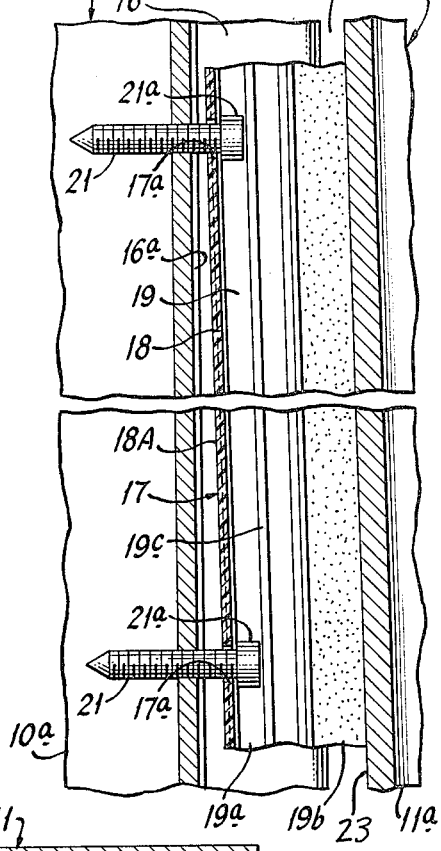
Fig. 2
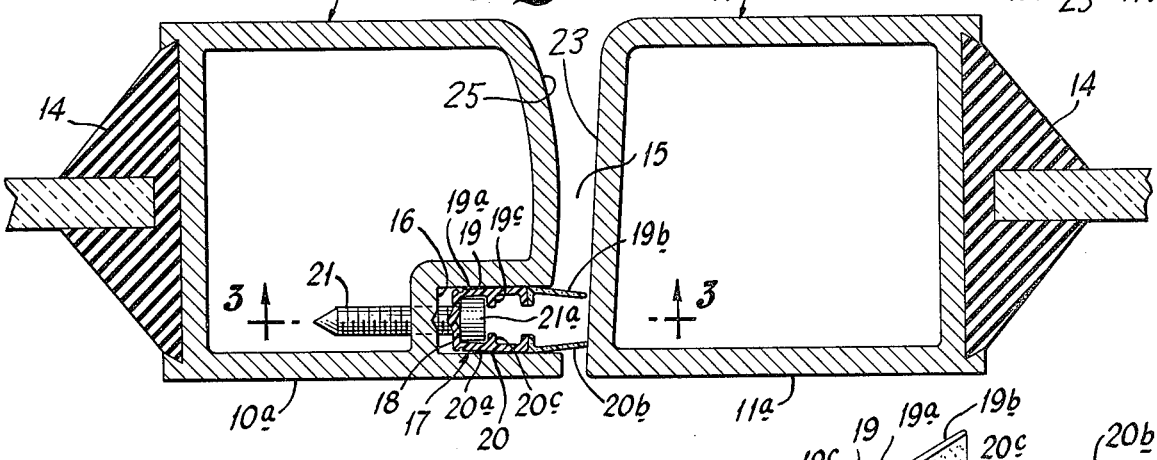
Fig. 4
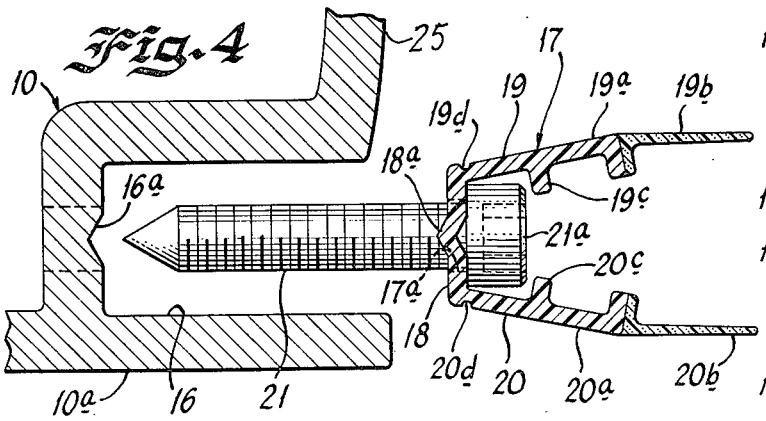
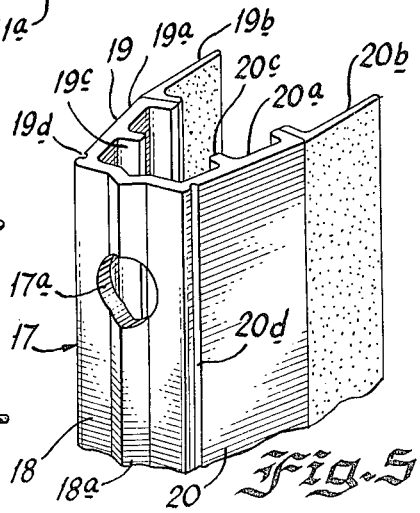
Fig. 5

WEATHER STRIPPING MATERIAL

The present invention relates to weather stripping materials and more particularly to an improved weather stripping material for weather sealing the movable edge of a movable door or window.

One of the problems encountered in attempting to weather seal the movable edge of a movable door or window is attributable to the fact that the movable edge of the door, for example, is rarely, if ever, exactly parallel with the adjacent facing structural surface which the weather stripping material must contact throughout its length in order to provide the desired uninterrupted weather seal. Moreover, this problem is aggravated with aging of the structure in which the door or window is mounted, which usually causes a progressive misalignment between the movable edge of the closure component and the adjacent structural surface with which the weather stripping material must cooperate to provide the desired weather seal.

Various weather stripping arrangements have been used and suggested which are addressed to the solution of this problem. Perhaps the most successful has been the use of an elongated U-shaped deformable metallic weather strip carrier which is adapted to be adjustably mounted within a channel formed in the movable edge of the closure component and is provided with a flexible weather stripping felt or row of bristles projecting outwardly from each leg of the carrier to engage the adjacent facing structural surface. Conventionally, the carrier is held in place in the channel by means of screws spaced along the carrier and extending through the base thereof to engage the adjacent edge material of the closure member. Springs are normally interposed between the base of the carrier and the bottom of the channel adjacent the screws so that distortion of the carrier is produced in response to selective in and out movement of the mounting screws, thereby to produce an edging contour of the weather stripping felt or bristles which matches or mates with the contour of the adjacent facing structural surface.

While the above described prior art weather stripping material is reasonably adequate for its purpose, at least for a limited period of time, it is open to certain objections which the present invention overcomes. First, the metal carrier is held in place by the pressure of the springs forcing the carrier against the undersides of the screw heads which means that as the screws are withdrawn to increase the extension of the weather stripping felt or bristles out of the carrier retaining groove, the spring tension is decreased permitting the carrier to more easily move back and forth within the groove as the door is opened or closed. Secondly, the cost of the U-shaped structure, complete with weather stripping felt or bristles, is relatively high. Thirdly, the effective life of the weather stripping felt or bristles is limited. Finally the most important, the cost of assembling the material into the receiving channel of the closure component is relatively high due to the fact that back up springs must be used which are tedious to control.

Accordingly, it is an object of the present invention to provide an improved weather stripping material which overcomes the above mentioned disadvantages of the described prior art weather stripping structure.

It is another object of the invention to provide an improved low-cost weather stripping material of the character described which may be easily installed and may be readily contoured to close and weather seal an elongated clearance aperture of irregular width.

It is a further object of the invention to provide an improved long-life weather stripping material of any described length which may be continuously extruded from two different plastic materials having different flexibility characteristics.

The invention, both as to its organization and method of installation and use, will best be understood by reference to the following specification, taken in connection with the accompanying drawings, in which:

FIG. 1 is a frontal view of an entrance way having double door closure components which are pivotally mounted at their outer vertical edges and are weather sealed at their meeting inner edges by means of the present improved weather stripping material;

FIG. 2 is a sectional view taken along the lines 2—2 in FIG. 1;

FIG. 3 is a sectional view taken along the lines 3—3 in FIG. 2;

FIG. 4 is an exploded fragmentary sectional view illustrating the relative shapes of the parts of the weather stripping assembly shown in FIG. 2 before the assembly is completed; and FIG. 5 is a perspective view illustrating a segmental portion of the present improved weather stripping material.

Referring now to the drawing and more particularly to FIG. 1 thereof, the present improved weather stripping material is there illustrated in its use to weather strip the elongated clearance gap between the adjacent facing vertical edges of movable doors 10 and 11 employed to close the entranceway 12 into a building 13. As shown, the doors 10 and 11 are hinge mounted at their remote edges upon the frame defining the entranceway opening. The door 10 comprises four aluminum extrusions 10*a*, 10*b*, 10*c* and 10*d* interconnected to form a vertical rectangle and within which a glass door panel is firmly anchored and sealed by means of rubber or plastic glazing strips 14. The door 11 is similarly constructed, it being provided with a front movable edge frame member 11*a* which faces, but is slightly displaced from the adjacent door frame member 10*a* to define an elongated clearance gap 15 therebetween when the two doors occupy their closed positions.

As best shown in FIG. 2 of the drawing, the hollow door frame member 11*a* is formed with a flat edge or structural wall surface 23 which faces a curved surface 25 of the frame member 10*a* and the surfaces generally diverge away from one another from a mid portion toward the rear or inside of the doors. In order to receive and support the weather stripping material used to close the clearance gap 15 between the door frame members 10*a* and 11*a*, the front outer corner of the frame member 10*a* is shaped or sectionally contoured during its extrusion to provide an elongated weather strip receiving channel 16 throughout the length thereof, the open side of which faces the adjacent wall surface 23 of the door frame member 11*a*.

In accordance with the present invention, improved weather stripping material 17 illustrated in FIGS. 2, 3, 4 and 5 is provided which may be readily and easily assembled with the door frame member 10*a* within the weather strip receiving channel 16. Briefly, the strip-like material 17 is of U-shaped cross section being provided with a base portion 18 and two laterally extending legs 19 and 20. Each of the legs 19 and 20 is of composite construction. Thus the leg 19 has a base portion 19*a* which joins and is formed integrally with the base 18 and an extended wiper portion 19*b* which is bonded to the end of base portion 19*a* throughout its length. Similarly, the other leg 20 comprises a base portion 20*a* which is formed integrally with the base 18 and an extended wiper portion 20*b* which is bonded to the end of the base portion 20*a* throughout its length. The bonding areas between the described leg parts is enhanced or increased by providing inwardly extending flanges at the respective outer ends of the base leg portions 19*a* and 20*a* at their respective inner meeting ends of the extended wiper leg portions 19*b* and 20*b*.

As best shown in FIGS. 2, 3 and 4 of the drawings, the weather strip material 17 is adapted to be secured to the door frame member 10*a* within the channel 16 by means of fasteners in the form of fastening screws 21 which are located at spaced intervals along the strip and are adapted to be threaded into openings in the metal forming the bottom of the channel 16. Each of these screws is provided with a head 21*a* which in use is located at the bottom of the U-shaped strip 17. Preferably, the strip 17 is preperforated in production at spaced intervals 17*a* therealong in order to accomodate the shanks of the fastening screws 21.

In order to retain the heads 21 of the fastening screws 21 in relatively fixed positions with the U-shaped material 17, ridges 19*c* and 20*c* are provided along the leg portions 19*a* and 20*a*, respectively, which are formed integrally with these leg portions and face toward each other within the U-shaped strip 17. As will be apparent by reference to FIG. 2 of the drawing, these ridges function as barriers to prevent withdrawal of the screw heads 21*a* from the channel 16 without also withdrawing the longitudinally adjacent segments of the strip 17.

In its finished but uninstalled state, the strip 17 is of the approximate configuration illustrated in FIGS. 4 and 5 of the drawing, i.e. the legs 19 and 20 are somewhat flared away from each other. For the purpose of facilitating pivotal movement of these legs relative to the base 18 at the junction lines between the legs and the base and without substantial bending of the leg portions 19*a* and 20*a*, flex grooves 19*d* and 20*d* of half moon cross section are provided immediately adjacent the ends of the base 18 which extend throughout the length of the strip 17. If desired, the strip base portion 18 may also be provided with a V-shaped positioning ridge 18*a* which is adapted to mate with a similar groove 16*a* formed at the bottom of the channel 16 in order more firmly to position and anchor the strip 17 within the channel 16 when the strip base portion 18 is drawn into contact with the bottom of the channel 16 by means of the fastening screws 21. It will be understood that this ridge, if provided, extends throughout the length of the strip 17.

In production, the composite plastic structure of the material 17 is produced by employing a conventional dual extrusion process to form the material. More specifically, a thermoplastic polyvinyl chloride plastic is extruded through one extrusion die to form the base portions 18, 19 and 20 of the structure and a thermoplastic polyurethane plastic is extruded through two additional extrusion dies to form the wiper leg portions 19*b* and 20*b* of the structure. These materials, in their heated state, are self-bonding to each other to form the material cross-section illustrated in FIGS. 4 and 5 as the materials exit from the extrusion dies. Cold bath setting of these plastic materials in employed to produce the finished structure, following which the material is subjected to a continuous punching operation to form the openings 17*a* through the base portion thereof.

As will be understood by those knowledgable in the plastic chemistry field, the polyvinyl chloride base portions 18, 19 and 20 of the finished strip structure, while somewhat flexible, are far less flexible than the polyurethane wiper leg portions 19*b* and 20*b* of the structure. Thus, the leg portions 19*b* and 20*b* may easily bend and then self-restore to their original settings as the tip edges thereof are repeatedly brought into contact with and then released from contact with an adjacent structural surface.

The method of assembling the weather stripping material with the door frame member 10*a*, for example, will be somewhat apparent from the foregoing explanation. Briefly summarized, a strip of the material 17, cut to a length equal to the approximate length of the door 10, is fitted with fastening screws 21 at each of the openings 17*a* throughout its length. In order to assemble each screw 21 with the strip length, the leg portions 19*a* and 20*a* are manually spread apart at a point adjacent the opening to permit the head 21*a* of the screw to clear the ledges 19*c* and 20*c* as the screw is thrust through the opening 17*a* into contact with the base 18 of the strip. When the manual leg spreading force is removed, the leg parts 19*a* and 20*a* spring toward each other, thereby moving the ledges 19*c* and 20*c* over the top of the screw head 21*a* to prevent the screw from falling away from the strip 17.

After the length of strip material 17 has been fitted with fastening screws 21 in the manner explained above, the base 18 and legs 19 and 20 are positioned at the mouth of the channel 16 and the screws 21 are driven into the metal forming the bottom of this channel. A conventional or power actuated screw driver may be used for this purpose. As the screw driving operation proceeds, the legs 19 and 20 are flexed toward each other about the flexing grooves 19*d* and 20*d*, and the material is drawn into the channel until it occupies a position approximating that shown in FIG. 2 of the drawing. Due to the inherent self-restoring characteristics of the material forming the portions 18, 19 and 20 of the strip, the outer surfaces of the legs 19 and 20 press outwardly against the adjacent wall surfaces of the channel 16 to form an effective seal which prevents air and moisture or a mixture thereof from leaking around the strip 17 within the channel 16. As the strip of material 17 is drawn into the channel 16 in the manner just explained, the ledges 19*c* and 20*c* are pushed toward each other over the tops of the screw heads 21*a* to confine the screw heads between these ledges and the base portion 18 of the strip. In the final assembled state, the highly flexible wiper leg portions 19*b* and 20*b* extend outwardly from the mouth of the channel 16 for wiping engagement with the adjacent structural surface 23 of the door frame 11*a*. Due to the high degree of flexibility of the leg parts 19*b* and 20*b*, these parts may be repeatedly deformed as one or both of the doors 10 and 11 are opened and closed without damage to these leg parts over a long period of time. Moreover and as best illustrated in FIG. 2 of the drawing, the continuous contact between the outer or tip edges of one or both of the leg parts 19*b* and 20*b* with the adjacent structural surface 23 provides an effective weather seal for the space 15 separating the adjacent moveable wall surfaces 23 and 25 of the door frame members 10*a* and 11*a*.

If this elongated space is of irregular or non-uniform width throughout its length, the strip of present improved weather stripping material may be readily adjusted to accomodate the gap width change and thus preserve the desired weather seal between the door frame members 10*a* and 11*a* when the doors 10 and 11 are closed. Thus by changing the degree of penetration of selected screws 21 into the bottom wall of the channel 16 as required and as shown in FIG. 3 of the drawing, the strip of material 17 may be flexed toward and away from the bottom of the channel 16 to change the edge contour of the outer or tip edges of the leg parts 19*b* and 20*b* as required to insure meeting or wiping engagement of these edges with the adjacent structural surface 11*b* regardless of such gap width variations. Such flexure of the strip is permitted due to the inherent flexibility of the plastic materials forming the strip. Moreover, the internal ledges 19*c* and 20*c* act as barriers to restrain the screw heads 21*a* against movement in and out of the strip and thus insure positive displacement of selected portions of the strip as the selected screws are retracted to partially withdraw the selected strip portions from the channel 16. Thus the wiping contours of the few edges of the legs 19*b* and 20*b* may be altered as required to insure wiping engagement thereof with the adjacent structural wall surface 23 throughout its length.

While the best mode of practicing the invention has been described, it will be understood that various modifications may be made therein which are within the true spirit and scope of the invention as defined in the appended claims.

I claim:

1. A weather stripping material comprising an elongated strip of substantially U-shaped cross section having a base and two spaced apart legs joining said base throughout their lengths and extending away from said base throughout their widths, said legs each having a base leg portion and an extended wiper portion formed of a flexible plastic material which is joined to the companion base leg portion throughout its length, each of said wiper portions being adapted to wipe against an adjacent structural surface at its outer edge and to engage said surface throughout its length to provide a weather seal between the engaged edge and structural surface, said base adapted to receive the shanks of fasteners extended therethrough at spaced intervals for supportively attaching said weather stripping material to a door or the like, at least one of said legs having an inwardly directed ridge along the length thereof on an inside surface facing the opposite leg in parallel spaced relation to said base forming a channel shaped recess for accommodating the head of said fasteners, said base and said ridge engageable with opposite surfaces of said heads for moving said base toward and away from said door in response to movement of the shank of said fasteners relative to said door to adjust the position of said weather stripping material on said door.

2. A weather stripping material as claimed in claim 1 wherein said base leg portions are formed of a relatively stiff flexible plastic material and said extended wiper portions are formed of a flexible plastic material having greater flexibility than that of the plastic material from which said base leg portions are formed.

3. A weather stripping material as claimed in claim 1 or claim 2, wherein said base is provided with fastener receiving openings at spaced intervals throughout its length.

4. A weather stripping material as claimed in claim 1 or claim 2, wherein said legs are provided with inwardly disposed ridges along the lengths thereof which face toward each other and are adapted to function as fastener head retaining barriers.

5. A weather stripping material as claimed in claim 4 wherein said base is provided with spaced apart fastener receiving openings at intervals along its length.

6. A weather stripping material as claimed in claim 1 or claim 2, wherein said strip is provided with an elongated depression at the junction line between one of said legs and said base to facilitate insertion of said strip into the weather strip receiving channel of a structural member.

7. A weather stripping material as claimed in claim 1 or claim 2, wherein said strip is provided with an elongated depression at the junction lines between said legs and said base to facilitate bending of said legs toward and away from each other about said junction lines and thus facilitate insertion of said strip into the weather strip receiving channel of a structural member.

8. A weather stripping material as claimed in claim 7, wherein said legs are provided with inwardly disposed elongated ridges along the lengths thereof which face toward each other and are adapted to function as fastener head retaining barriers.

9. The weather stripping material of claim 1 wherein said leg having said ridge on the inside surface thereof is pivotally movable with respect to an edge of said base to permit movement of said leg between a first position permitting insertion of the heads of said fasteners into said channel shaped recess and a second position for retaining said heads in said recess by engagement of said base or said ridge on opposite sides of said heads.

10. A weather stripping material for a building component having a moveable structural member provided with an elongated weather strip receiving channel along one edge thereof, comprising an elongated flexible plastic strip of substantially U-shaped cross section which is adapted to be inserted into said channel and is provided with a base and two spaced apart legs joining said base throughout their lengths, the outer end segments of each of said legs being formed of a plastic material having greater flexibility than that of the companion base joining segment of the same leg and said companion outer end and base segments of each leg being bonded together throughout their lengths, said legs being provided with inwardly disposed elongated ridges along the lengths thereof which face toward each other and are adapted to function as fastener head retaining barriers, whereby the contour of said strip may be adjusted to conform to an irregular structural surface which faces said channel through individual adjustments of spaced fasteners extending through said base and having heads retained between said base and said ridges by engagement therewith.

11. A weather stripping material as claimed in claim 1 or 2, wherein said legs are flared away from each other in their normal state and are adapted to be forced toward each other against the inherent self-restoring bias thereof as said material is inserted into the weather strip retaining groove of a structural member.

12. A closure such as a door having an edge member with a longitudinal groove therein having an open side adapted to closely face the edge of an adjacent closure or jamb surface when said closure is in a closed position relative to said edge;

an elongated weatherstrip mounted in said groove having a generally U-shaped transverse cross section comprising a base and a pair of legs, at least one of said legs having an outer end portion of flexible plastic material extending outwardly of said groove for sealing engagement against said edge when said closure is in said closed position, said leg having an inner portion of relatively stiff material adjacent said base and normally sealed in said groove;

a plurality of headed fasteners for supportively attaching said weatherstrip in said groove, said fasteners including threaded shanks extending through said base of said weatherstrip at spaced apart intervals along the length thereof, said shanks threadedly engaging a base wall of said groove for axial movement of said shanks and the heads of said fasteners in response to axial rotation of said shanks;

said weatherstrip including rib means on at least one of said legs for engagement with said fastener heads on one side for moving said weatherstrip outwardly in said groove to provide a continuous seal between an outer end portion of said leg and said adjacent edge in response to selective rotation of said fasteners shanks.

13. The closure of claim 12 wherein said fastener heads have an opposite side engageable with said base of said weatherstrip for moving the same into said groove upon selective rotation of said fastener shanks in an opposite direction to adjust the position of said outer end portion of said leg with respect to said adjacent edge.

* * * * *